US011428485B2

(12) United States Patent
Engel, IV et al.

(10) Patent No.: US 11,428,485 B2
(45) Date of Patent: Aug. 30, 2022

(54) FIREARM WITH FIELD-REPLACEABLE BLANK-FIRE CHAMBER PREVENTING CHAMBERING OF LIVE ROUNDS

(71) Applicant: Textron Systems Corporation, Hunt Valley, MD (US)

(72) Inventors: William Henry Engel, IV, Cockeysville, MD (US); David Timothy Horst, Bel Air, MD (US)

(73) Assignee: Textron Systems Corporation, Hunt Valley, MD (US)

( * ) Notice: Subject to any disclaimer, the term of this patent is extended or adjusted under 35 U.S.C. 154(b) by 0 days.

(21) Appl. No.: 17/150,218

(22) Filed: Jan. 15, 2021

(65) Prior Publication Data

US 2022/0228828 A1 Jul. 21, 2022

(51) Int. Cl.

| | |
|---|---|
| ***F41A 21/10*** | (2006.01) |
| ***F41A 21/12*** | (2006.01) |
| ***F41A 11/02*** | (2006.01) |
| ***F41A 21/48*** | (2006.01) |
| ***F41A 21/26*** | (2006.01) |

(52) U.S. Cl.
CPC ..... *F41A 11/02* (2013.01); *F41A 21/26* (2013.01); *F41A 21/48* (2013.01)

(58) Field of Classification Search
CPC ..... F41A 21/12; F41A 21/10; F41A 21/14; F41A 9/23; F42B 8/10
See application file for complete search history.

(56) References Cited

U.S. PATENT DOCUMENTS

| | | | | | |
|---|---|---|---|---|---|
| 33,876 | A | * | 12/1861 | Broadwell | F41A 3/10 89/24 |
| 672,824 | A | * | 4/1901 | Elterich | F42B 8/10 102/446 |
| 1,179,021 | A | * | 4/1916 | Mayer | F42B 8/10 102/446 |
| 1,191,618 | A | * | 7/1916 | Saffold | F41A 21/10 42/77 |
| 1,269,661 | A | * | 6/1918 | Vernia | F41A 21/10 42/77 |
| 2,902,933 | A | * | 9/1959 | Moldofsky | F42B 8/10 102/446 |
| 3,384,989 | A | * | 5/1968 | Thomas | F41A 21/10 D22/108 |

(Continued)

FOREIGN PATENT DOCUMENTS

KR 100685452 B1 2/2007

*Primary Examiner* — Derrick R Morgan
(74) *Attorney, Agent, or Firm* — BainwoodHuang

(57) ABSTRACT

A firearm for firing case-telescoped (CT) rounds includes a barrel configured for transit of a bullet of a live CT cartridge in a live-fire operating mode. The live CT cartridge is chambered and fired from a live-fire chamber installed in the live-fire operating mode. The firearm further includes a blank-fire chamber configured to chamber and fire a blank CT cartridge in a blank-fire operating mode, wherein the blank-fire chamber has a second diameter less than a first diameter of the live-fire chamber, to prevent chambering of the live CT cartridge in the blank-fire operating mode. The arrangement can enhance safety by preventing accidental firing of a live round during operation when it is assumed that only blanks are being fired.

14 Claims, 5 Drawing Sheets

(56) References Cited

U.S. PATENT DOCUMENTS 3,437,040 A * 4/1969 Koehler ..... F42B 8/10 102/446
3,640,013 A * 2/1972 Franklin ..... F41A 21/10 102/446
4,056,038 A * 11/1977 Rath ..... F41C 7/12 89/184
4,126,954 A * 11/1978 Plummer ..... F41A 21/12 102/444
4,270,294 A * 6/1981 Compton ..... F41A 3/10 42/24
5,157,210 A * 10/1992 Davis ..... F42B 7/02 102/446
6,446,559 B1 * 9/2002 Vallender ..... F42B 7/04 102/446
8,201,487 B2 6/2012 Dueck et al.
8,434,254 B1 * 5/2013 Watchorn ..... F41A 9/71 42/50
8,763,510 B2 7/2014 Dueck et al.
9,188,402 B2 * 11/2015 Giannini ..... F41A 9/64
9,574,838 B2 2/2017 Giannini et al.
9,772,154 B2 * 9/2017 Foster ..... F41C 7/02
9,784,512 B1 10/2017 Harding
9,927,194 B2 3/2018 Muska
10,222,153 B1 3/2019 Harding
10,228,202 B2 3/2019 Jarboe
10,260,831 B2 4/2019 Biran et al.
10,352,639 B2 7/2019 Doty et al.
D874,601 S 2/2020 Hills
D884,108 S 5/2020 Müller
10,941,994 B2 * 3/2021 Shipley ..... F41A 3/34
2008/0098922 A1 * 5/2008 Gleue ..... F42B 5/16 102/446
2012/0005931 A1 * 1/2012 Kelly ..... F41A 21/12 42/14
2018/0364001 A1 12/2018 Doty et al.
2019/0049199 A1 * 2/2019 Shipley ..... F41A 3/34
2019/0049201 A1 * 2/2019 Shipley ..... F41A 15/00

* cited by examiner

FIREARM WITH FIELD-REPLACEABLE BLANK-FIRE CHAMBER PREVENTING CHAMBERING OF LIVE ROUNDS

STATEMENT OF GOVERNMENT RIGHTS

The invention was made with government support under W15QKN-19-9-1025 awarded by the US Army. The government has certain rights in the invention.

BACKGROUND

This invention is generally in the field of small arms, and relates specifically to use of a firearm with blank cartridges in a blank-fire operating mode.

SUMMARY

A firearm for firing case-telescoped (CT) rounds includes a barrel configured for transit of a bullet of a live CT cartridge in a live-fire operating mode. The live CT cartridge is chambered and fired from a live-fire chamber installed in the firearm in the live-fire operating mode, the live-fire chamber having a first inside chamber diameter. The firearm further includes a blank-fire chamber configured to chamber and fire a blank CT cartridge in a blank-fire operating mode, wherein the blank-fire chamber has a second diameter less than the first diameter to prevent chambering of the live CT cartridge in the blank-fire operating mode. The arrangement can thus enhance safety by preventing accidental firing of a live round during operation when it is assumed that only blanks are being fired.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Brief Overview

A disclosed firearm uses a reduced-diameter blank ammunition cartridge and matching firearm chamber, along with the associated firearm feed mechanisms. The arrangement addresses a safety issue encountered when firing blank ammunition, in that standard firearms can chamber and fire live ammunition even when equipped to fire blank ammunition. The advantage of the disclosed technique is that it enables a properly equipped firearm to feed and fire blank ammunition while preventing live ammunition from being chambered and fired. For blank-fire operation using the reduced-diameter blank cartridges, the firearm is equipped with a matching chamber and feed mechanisms. The chamber diameter is reduced enough, relative to the standard live-fire chamber, that an attempt to feed a live cartridge into the reduced-diameter chamber results in the live cartridge jamming in the chamber opening, preventing the firearm from functioning.

DESCRIPTION OF EMBODIMENTS

Figure 1:
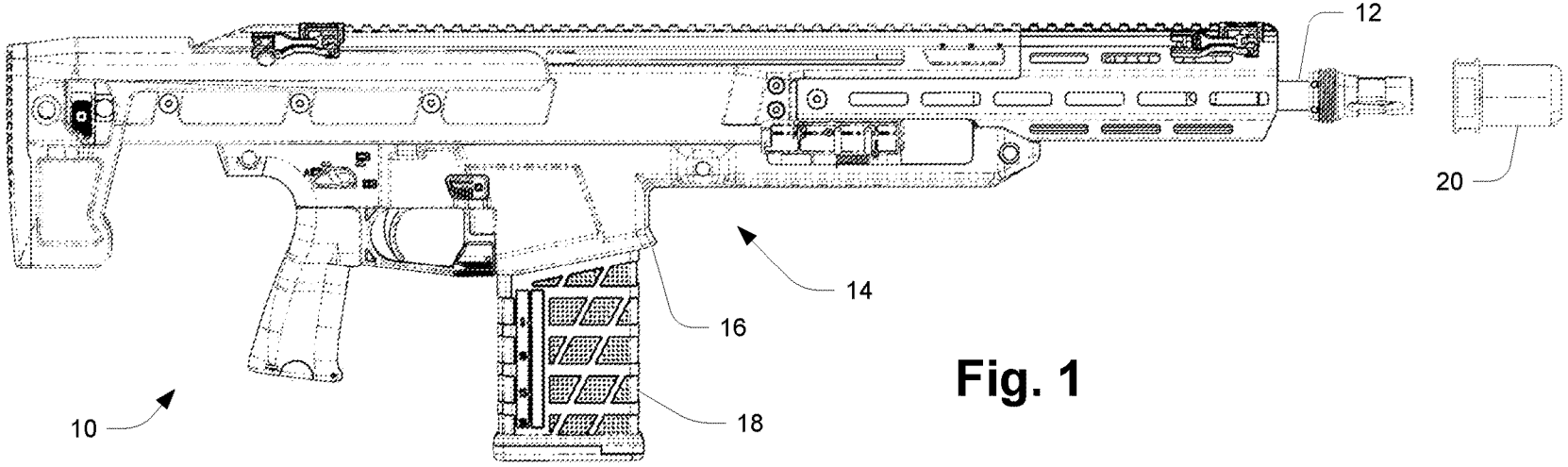
FIG. 1 is a side view of a firearm (carbine) with a separate blank-fire adapter.
Figure 2:
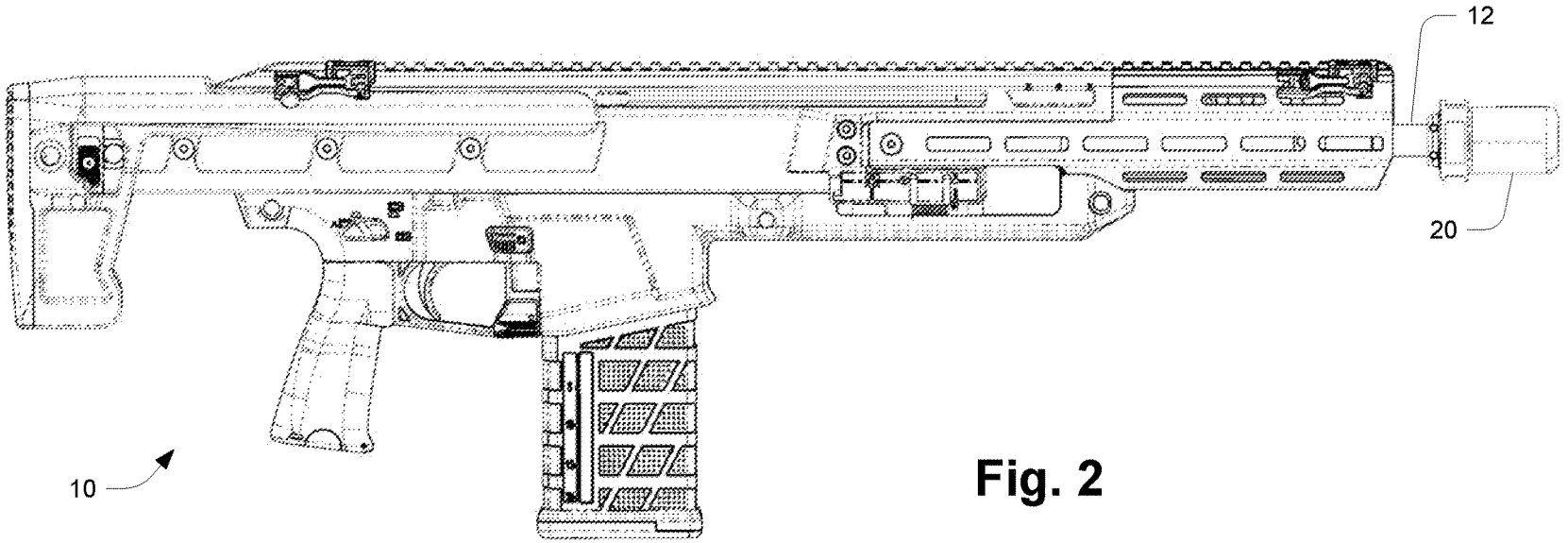
FIG. 2 is a side view of the firearm with blank-fire adapter installed.

FIGS. 1 and 2 show a carbine firearm 10 for firing case-telescoped (CT) ammunition, also referred to herein as "cartridges" or "rounds". In pertinent part the firearm 10 has a barrel 12 and a central area referred to herein as a chamber area 14. The chamber area 14 includes a magazine well 16 for receiving a magazine 18 containing the CT ammunition. As described more fully herein, the firearm 10 can be used in both a conventional live-fire mode in which it fires live, lethal rounds, also known as "tactical cartridges", as well as a blank-fire mode in which it "fires" blank rounds having no lethal slugs. For blank-fire operation, a blank-fire adaptor 20 is used as is generally known. FIG. 2 shows the firearm 10 with blank-fire adaptor 20 installed at the end of the barrel 12. As described more fully below, the firearm 10 has particular configuration, along with corresponding configuration of the live and blank rounds, that prevents live rounds from being chambered when the firearm is being used in blank-fire mode, enhancing safety.

Figure 3:
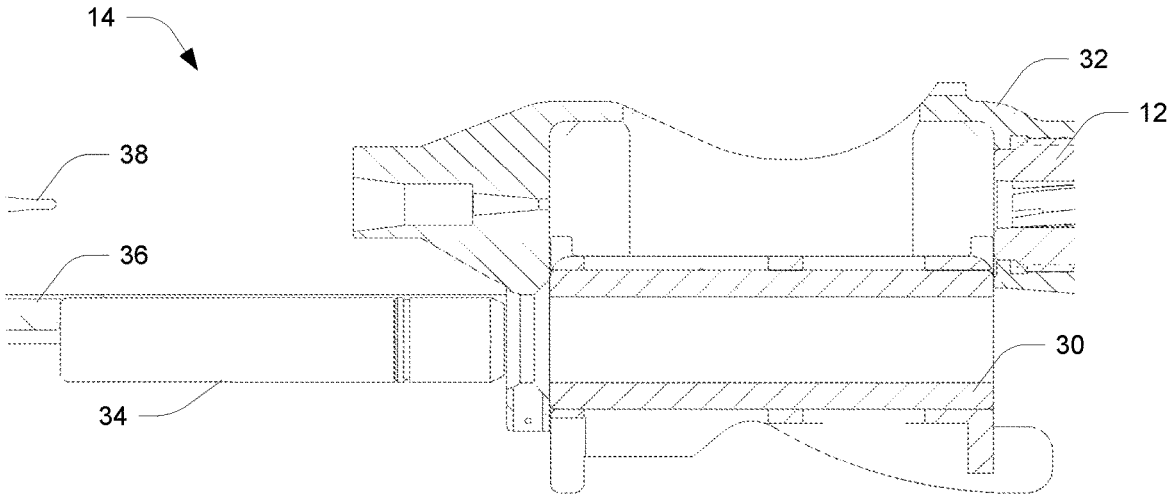
FIG. 3 is a section side view of a chamber area of the firearm, depicting a live round outside a live-fire chamber in a feed position.
Figure 4:
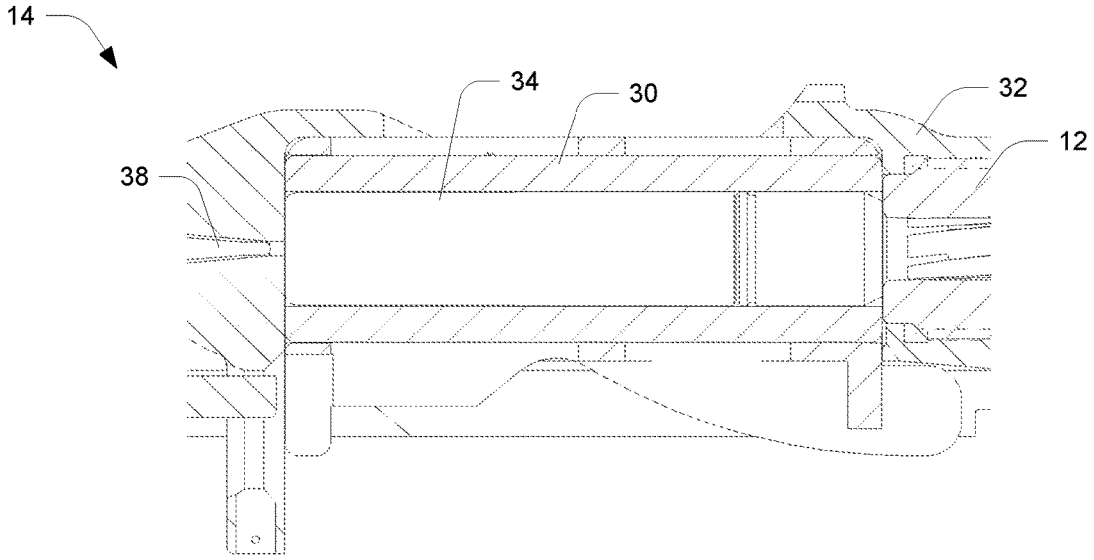
FIG. 4 is a section side view of the chamber area of the firearm, depicting the live round inside the live-fire chamber after loading and movement of the chamber to a firing position.

FIGS. 3-4 illustrate structure of the firearm 10 in the chamber area 14, within the outer stock or housing and thus not visible in FIGS. 1-2. FIGS. 3-4 are side sectional views. One characteristic of the firearm 10 is its use of a moveable chamber 30, which is a cylindrical member that moves up and down during a firing cycle. In the firing position (FIG. 4), the chamber 30 is received by a barrel extension 32 mounted at the near end of the barrel 12. In the ejection/leading position (FIG. 3), the chamber 30 is out of the barrel extension 32. This structure is particular suited to use with CT ammunition, which lends itself better to push-through extraction rather than a pull-type extraction as with conventional (non-CT) ammunition.

FIG. 3 illustrates the configuration at the very end of recoil, in which the chamber 30 is in its downward position, away from the barrel extension 32 and aligned with a next round 34 which has been pushed up into a loading position at the top of the magazine 18 (FIG. 1). A rammer 36 and firing pin 38 are attached to a carrier (not shown) that reciprocates back-and-forth during recoil and counter-recoil. In FIG. 3, the rammer 36 is in position to push the round 34 into the chamber 30 during the subsequent counter-recoil phase of operation. Although not shown in FIG. 3, in typical operation the chamber 30 will have a spent cartridge in it from the present firing cycle, and when the rammer 36 moves forward during counter-recoil, the spent cartridge is ejected by the next cartridge 34 being pushed into the chamber 30.

FIG. 4 shows the configuration at the end of counter-recoil. The cartridge 34 is fully within the chamber 30, which has risen into the barrel extension 32 to become aligned with the barrel 12, and the firing pin 38 is adjacent the rear of the cartridge 34 in preparation for firing.

The operation and essential structure outlined above are the same for both live-fire and blank-fire operating modes. As described below, key differences are that the blank rounds are slightly smaller in diameter than the live rounds, and in the blank-fire mode the firearm 10 uses a special blank-fire chamber that has a correspondingly smaller diameter so as to accept blank rounds but be unable to accept live rounds, preventing live rounds from being chambered and fired in the blank-fire operating mode. In one embodiment, this size difference is sufficiently small that both rounds may be accommodated by the same type of magazine 18, i.e., no special magazine is required for blank-fire operation.

Figure 5:
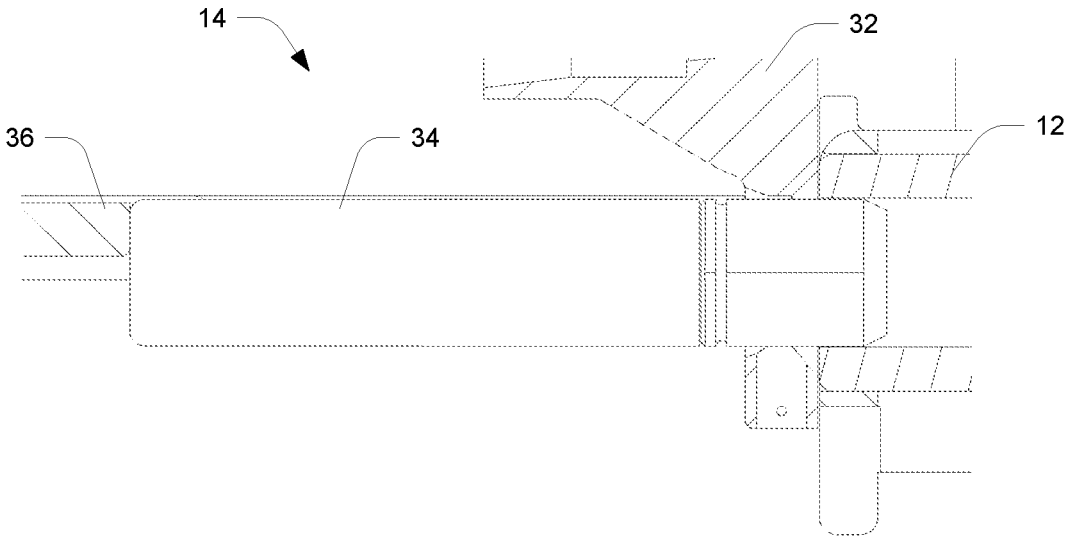
FIG. 5 is a section side view of the chamber area of the firearm, depicting in greater detail the entry of a live round into the live-fire chamber during ramming.
Figure 6:
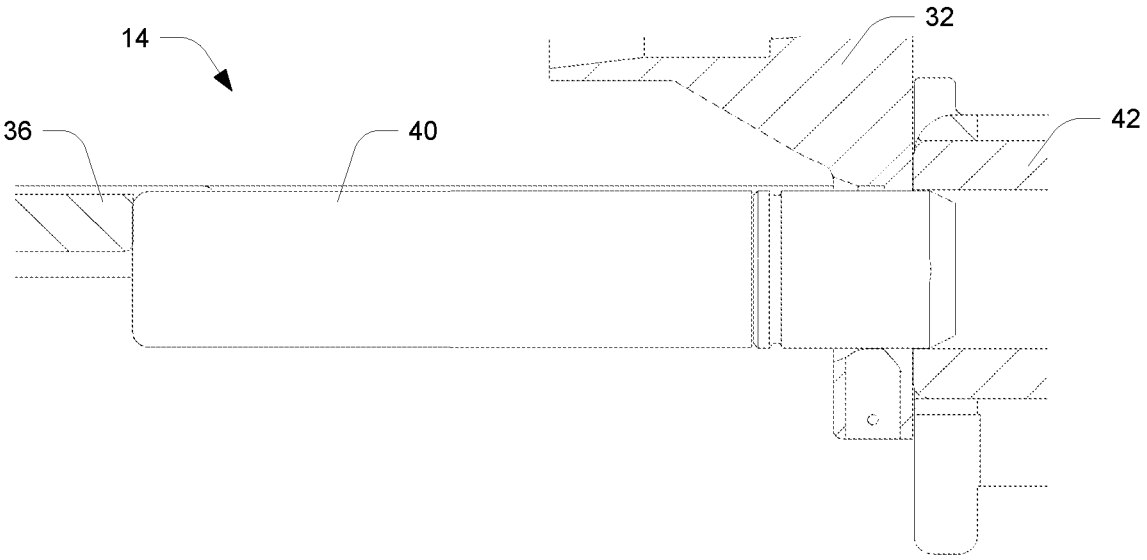
FIG. 6 is a section side view of the chamber area of the firearm, depicting in greater detail the entry of a blank round into a blank-fire chamber during ramming.
Figure 7:
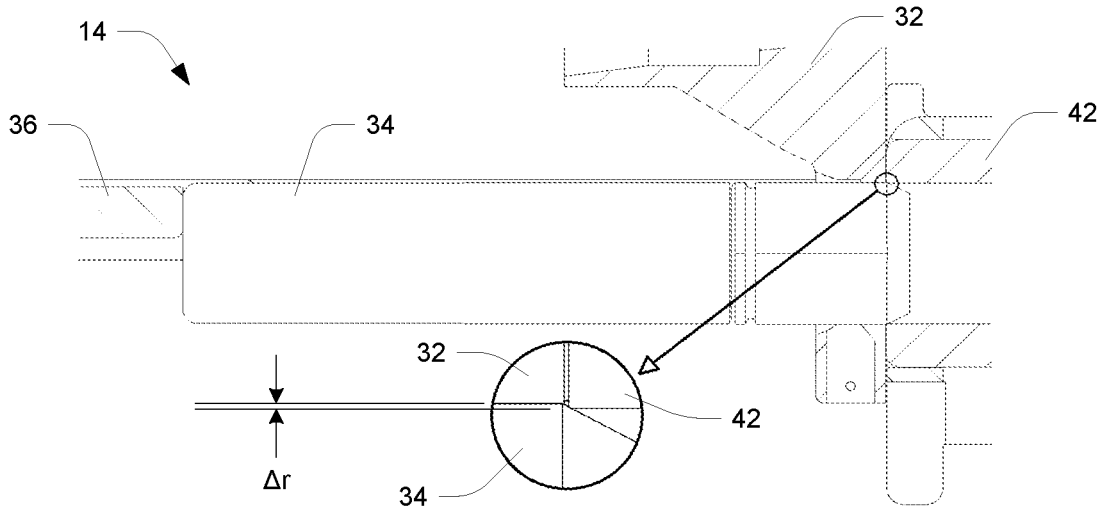
FIG. 7 is a section side view (with inset detail) of the chamber area of the firearm, depicting in greater detail the interference which prevents a live round from being pushed into the blank-fire chamber during attempted ramming.

FIGS. 5-7 illustrate the above in additional detail. FIG. 5 shows the ramming of a live cartridge 34 into a live-fire chamber 12 at the beginning of counter-recoil during live-fire operation. FIG. 6 similarly shows the ramming of a blank cartridge 40 into a blank-fire chamber 42 at the beginning of counter-recoil during blank-fire operation. As the size differences are quite small, the two depictions in FIGS. 5-6 look almost identical. FIG. 7 shows the unsafe attempt to chamber a live round 34 into the blank-fire chamber 42 during operation. As shown in the inset, the small radius difference $\Delta r$ between the cartridge 34 (outer radius) and the chamber 42 (inner radius) is sufficient to prevent the live round 34 from being chambered. In one embodiment, the dimension $\Delta r$ is 0.005", corresponding to a diameter difference of 0.010", which creates sufficient interference to require on the order of 400 pounds of force to push the cartridge 34 into the chamber 42. In a typical firearm 10, the force generated by the carrier and recoil spring during recoil is on the order of 15-20 pounds. As a result, if there is an attempt to chamber a live round 34 when the blank-fire chamber 42 is installed in the firearm 10, the result will be a jam of the firing mechanism rather than the potentially deadly situation of chambering a live round 34 with a belief that it is a blank round 40. Those skilled in the art will appreciate that this diameter difference may be varied slightly in alternative embodiments to still provide sufficient interference to prevent chambering of a live CT cartridge during blank-fire operation while also maintaining compatibility with the magazine 18 and other feed-related features of the firearm 10.

Figure 8:
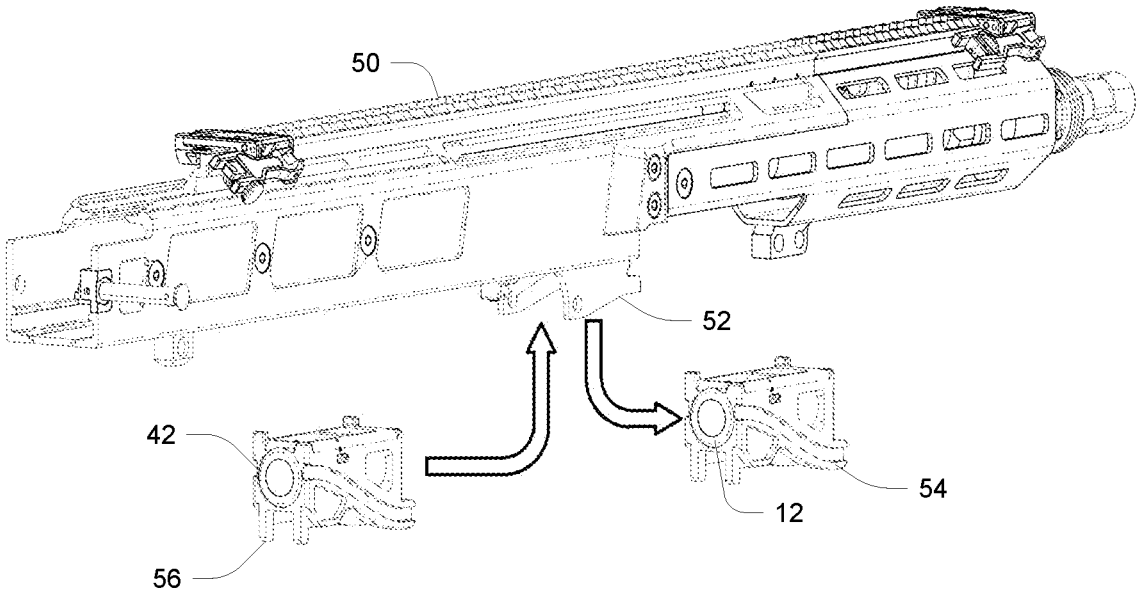
FIG. 8 is a perspective view of an upper receiver part of the firearm with field-swappable live-fire and blank-fire chambers.

FIG. 8 shows the manner of exchanging chamber types to convert between live-fire and blank-fire operating modes, which is a field operation. The firearm 10 is partially dissembled, exposing a lower part of an upper receiver 50 which includes a slide 52 that reciprocates during operation. Each chamber 12, 42 is mounted within a respective chamber carrier 54, 56 (e.g., such as by press-fitting), and the conversion to blank-fire mode is accomplished by removing the live-fire chamber carrier 54 (with mounted chamber 12) and installing the blank-fire chamber carrier 56 (with mounted chamber 42) in its place. Each chamber carrier 54, 56 has an s-shaped slot engaging corresponding blunt fingers of the slide 45 in a camming arrangement, so that during operation the reciprocation of the slide 52 causes corresponding up-down movement of the chamber 54 or 56 as described above.

Those skilled in the art will appreciate that alternative mechanisms may be used for moving an installed chamber 12 or 42 between the firing position and ejection/loading position.

Figure 9:
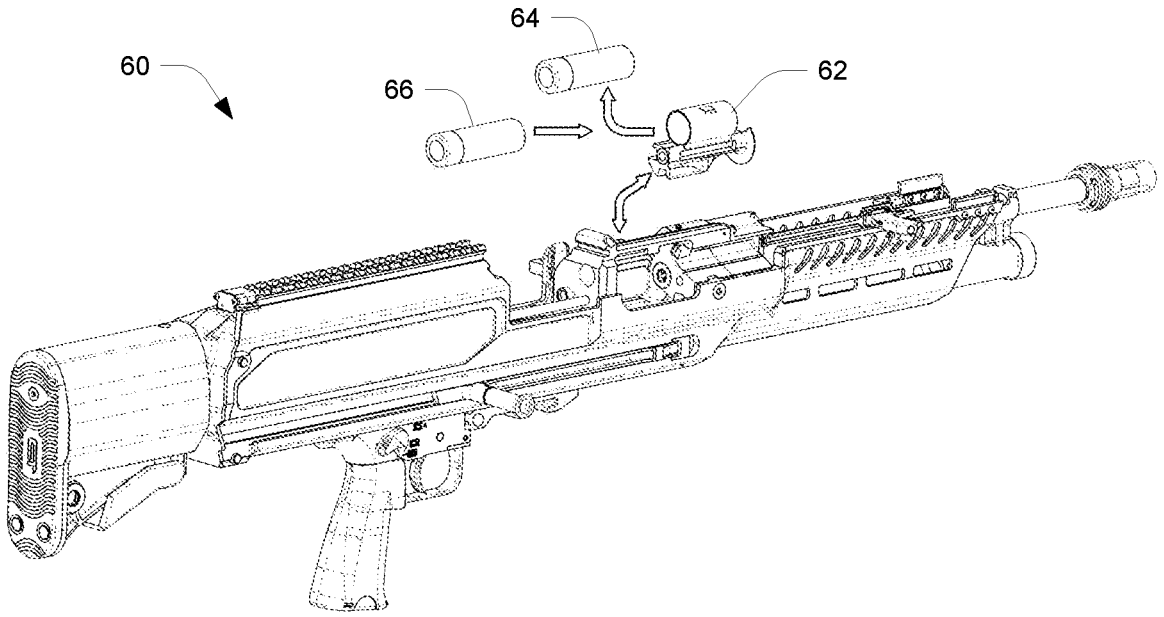
FIG. 9 is a perspective view of an alternative firearm (machine gun) with field-swappable live-fire and blank-fire chambers.

FIG. 9 shows a machine-gun type of firearm 60 that employs analogous features for preventing chambering of a live round. As shown, a chamber carrier 62 can receive either a live-fire chamber 64 or a blank-fire chamber 66 having a slightly smaller inner diameter, just as for blank-fire chamber 42 (FIGS. 6-7). In this case the chamber carrier 62 has limited arcuate movement transverse to the barrel to move an installed chamber 64 or 66 between a firing position and an ejection/loading position. An attempt to use live cartridges when the blank-fire chamber 66 is installed will result in jamming, as for the carbine firearm 10 as described above.

Referring back to the carbine firearm 10 of FIGS. 1-8, it will be appreciated that the blank-fire adapter 20 and blank-fire chamber 42 may conveniently be provided as a kit, either with or apart from blank rounds 40, for adapting an existing firearm 10 to blank-fire operating mode. A similar kit may be provided for the machine-gun firearm 60.

While various embodiments of the invention have been particularly shown and described, it will be understood by those skilled in the art that various changes in form and details may be made therein without departing from the scope of the invention as defined by the appended claims.

What is claimed is:

1. A firearm for firing case-telescoped (CT) rounds, comprising:

a barrel configured for transit of a bullet of a live CT cartridge in a live-fire operating mode, the live CT cartridge being chambered and fired from a live-fire chamber member installed in the firearm in the live-fire operating mode, the live-fire chamber member having a first inside chamber diameter; and a blank-fire chamber member configured to chamber and fire a blank CT cartridge in a blank-fire operating mode, the blank-fire chamber member having a second inside chamber diameter less than the first inside chamber diameter to prevent chambering of the live CT cartridge in the blank-fire operating mode; and wherein the live-fire chamber member and the blank-fire chamber member are useable separately and exchangeable depending on the operating mode.

2. The firearm of claim 1, including a mechanism for moving the blank-fire chamber member or live-fire chamber member between a firing position aligned with the barrel and an ejection/loading position away from the barrel.

3. The firearm of claim 2, wherein depending on the operating mode, the blank-fire chamber member or live-fire chamber member is retained in a respective field-replaceable chamber carrier, and the mechanism includes a slide in camming arrangement with the chamber carrier to convert reciprocating axial movement of the slide into transverse movement of the blank-fire chamber between the firing position and the ejection/loading position.

4. The firearm of claim 3, wherein the blank-fire chamber member and live-fire chamber member are retained by press-fitting into the respective chamber carrier.

5. The firearm of claim 2, wherein the blank-fire chamber member is a field-replaceable chamber retained in a chamber carrier, the chamber carrier configured for limited arcuate movement to move the blank-fire chamber member between the firing position and the ejection/loading position.

6. The firearm of claim 1, wherein the second inside chamber diameter is less than the first inside chamber diameter by a difference amount sufficient to require a corresponding large force to push the live CT cartridge into the blank-fire chamber member, the large force being substantially greater than a ramming force generated by a carrier and recoil spring of the firearm during counter-recoil so as to cause a jam when there is attempted use of the live CT cartridge during the blank-fire operating mode.

7. The firearm of claim 6, wherein the difference amount is 10/1000 of an inch.

8. A blank-fire kit for converting a firearm from a live-fire configuration to a blank-fire configuration, comprising: a blank-fire adaptor configured for affixing to a barrel of the firearm, the barrel providing for transit of a bullet of a live CT cartridge in a live-fire operating mode, the live CT cartridge being chambered and fired from a live-fire chamber member installed in the firearm in the live-fire operating mode, the live-fire chamber member having a first inside chamber diameter; and a blank-fire chamber member configured to be installed in the firearm in place of the live-fire chamber, the blank-fire chamber member configured to chamber and fire a blank CT cartridge in a blank-fire operating mode, the blank-fire chamber member having a second inside chamber diameter less than the first inside chamber diameter to prevent chambering of the live CT cartridge in the blank-fire operating mode; and wherein the live-fire chamber member and the blank-fire chamber member are useable separately and exchangeable depending on the operating mode.

9. The blank-fire kit of claim 8, wherein the blank-fire chamber member and live-fire chamber member are retained in a respective chamber carrier being configured with a mechanism of the firearm for moving the blank-fire chamber member or live-fire chamber member between a firing position aligned with the barrel and an ejection/loading position away from the barrel during the blank-fire or live-fire operating modes respectively.

10. The blank-fire kit of claim 9, wherein the mechanism includes a slide exhibiting reciprocating axial movement during operation, and the respective chamber carrier is a field-replaceable chamber carrier configured in camming arrangement with the slide to convert the reciprocating axial movement of the slide into transverse movement of the respective chamber carrier and corresponding movement of the blank-fire chamber member or live-fire chamber member between the firing position and the ejection/loading position.

11. The blank-fire kit of claim 10, wherein the blank-fire chamber member and live-fire chamber member are retained by press-fitting into the respective chamber carrier.

12. The blank-fire kit of claim 9, wherein the blank-fire chamber member is a field-replaceable chamber retained in a chamber carrier, the chamber carrier configured for limited arcuate movement to move the blank-fire chamber member between the firing position and the ejection/loading position.

13. The blank-fire kit of claim 8, wherein the second inside chamber diameter is less than the first inside chamber diameter by a difference amount sufficient to require a corresponding large force to push the live CT cartridge into the blank-fire chamber member, the large force being substantially greater than a ramming force generated by a carrier and recoil spring of the firearm during counter-recoil so as to cause a jam when there is attempted use of the live CT cartridge during the blank-fire operating mode.

14. The blank-fire kit of claim 13, wherein the difference amount is 10/1000 of an inch.

* * * * *